US012366424B2

(12) United States Patent
York et al.

(10) Patent No.: US 12,366,424 B2
(45) Date of Patent: Jul. 22, 2025

(54) FIREARM SIGHT HAVING LIFETIME ROUND COUNTER

(71) Applicant: Sig Sauer, Inc., Newington, NH (US)

(72) Inventors: Andrew W. York, Portland, OR (US); Donald L Cramer, Hillsboro, OR (US); Richard Bradley Brumfield, Athens, AL (US); John P. Nichols, Tigard, OR (US); Christopher J. Boudreau, Estacada, OR (US); David Pierson, Tualatin, OR (US)

(73) Assignee: SIG SAUER, INC., Newington, NH (US)

( * ) Notice: Subject to any disclaimer, the term of this patent is extended or adjusted under 35 U.S.C. 154(b) by 13 days.

(21) Appl. No.: 18/202,643

(22) Filed: May 26, 2023

(65) Prior Publication Data

US 2023/0384049 A1 Nov. 30, 2023

Related U.S. Application Data

(60) Provisional application No. 63/346,526, filed on May 27, 2022.

(51) Int. Cl.
*F41A 19/01* (2006.01)
*F41G 1/30* (2006.01)

(52) U.S. Cl.
CPC ..... *F41A 19/01* (2013.01); *F41G 1/30* (2013.01)

(58) Field of Classification Search
CPC ..... F41A 19/01
See application file for complete search history.

(56) References Cited

U.S. PATENT DOCUMENTS

| | | | | |
|---|---|---|---|---|
| 6,967,483 | B2 * | 11/2005 | Kwark | G01R 31/327 324/421 |
| 10,767,962 | B2 * | 9/2020 | York | F41G 1/44 |
| 10,907,934 | B2 * | 2/2021 | York | F41G 1/345 |
| 11,015,890 | B2 * | 5/2021 | Czarnecki | F41A 19/01 |
| 11,131,519 | B2 * | 9/2021 | Deng | G01S 5/0009 |
| 11,215,416 | B2 * | 1/2022 | Deng | H04N 5/28 |
| 11,269,318 | B2 * | 3/2022 | Cella | G01M 13/028 |
| 11,293,711 | B2 * | 4/2022 | Deng | G01S 19/34 |
| 11,320,224 | B2 * | 5/2022 | Deng | H04N 5/28 |
| 11,473,873 | B2 * | 10/2022 | Hamilton | F41G 1/38 |
| 11,709,027 | B2 * | 7/2023 | Canty | H04N 5/28 348/72 |
| 11,768,047 | B2 * | 9/2023 | Canty | H04N 5/28 348/211.4 |
| 11,835,311 | B2 * | 12/2023 | Leonhardt | G06F 1/163 |
| 11,988,474 | B2 * | 5/2024 | Broadway | F41G 3/165 |
| 11,994,364 | B2 * | 5/2024 | Hamilton | G02B 23/04 |
| 12,007,185 | B1 * | 6/2024 | Asbach | F41A 21/48 |
| 12,018,902 | B2 * | 6/2024 | Broadway | H04N 5/28 |
| 12,055,354 | B2 * | 8/2024 | Rozental | F41A 31/00 |
| 12,066,262 | B2 * | 8/2024 | Broadway | G01S 19/54 |
| 12,072,156 | B2 * | 8/2024 | O'Dell | F41A 31/00 |
| 12,085,362 | B2 * | 9/2024 | Hamilton | F41G 1/38 |
| 2008/0282595 | A1 * | 11/2008 | Clark | F41A 19/01 42/1.01 |

(Continued)

*Primary Examiner* — Michelle Clement
(74) *Attorney, Agent, or Firm* — Miller Nash LLP

(57) ABSTRACT

An accessory for a firearm includes a target sight for mounting to a portion of the firearm and a counter configured to count a total number of rounds fired by the firearm.

15 Claims, 3 Drawing Sheets

(56) References Cited

U.S. PATENT DOCUMENTS

| | | | | |
|---|---|---|---|---|
| 2010/0223829 | A1* | 9/2010 | Ufer | F41A 19/01 42/1.03 |
| 2019/0324260 | A1* | 10/2019 | Hamilton | G02B 27/0189 |
| 2021/0279578 | A1* | 9/2021 | Bryant | G06N 3/08 |
| 2021/0348886 | A1* | 11/2021 | Havens | F41G 3/165 |
| 2023/0384049 | A1* | 11/2023 | York | F41A 19/01 |
| 2023/0392892 | A1* | 12/2023 | Czarnecki | F41A 9/62 |
| 2024/0027155 | A1* | 1/2024 | Asbach | F41G 3/142 |
| 2024/0027157 | A1* | 1/2024 | Canty | F41A 33/00 |
| 2024/0068776 | A1* | 2/2024 | Havens | F41G 1/14 |
| 2024/0069323 | A1* | 2/2024 | Hamilton | G02B 23/12 |
| 2024/0085133 | A1* | 3/2024 | Leonhardt | G06F 1/163 |
| 2024/0102773 | A1* | 3/2024 | Havens | F41G 1/38 |
| 2024/0167790 | A1* | 5/2024 | Hamilton | F41A 27/24 |
| 2024/0191958 | A1* | 6/2024 | Asbach | H04N 5/28 |
| 2024/0201490 | A1* | 6/2024 | Hamilton | G02B 17/026 |
| 2024/0288239 | A1* | 8/2024 | Masarik | F41A 9/65 |
| 2024/0310145 | A1* | 9/2024 | Hamilton | G02B 23/04 |

* cited by examiner

FIREARM SIGHT HAVING LIFETIME ROUND COUNTER

CROSS-REFERENCE TO RELATED APPLICATIONS

This application claims benefit of U.S. Provisional Application 63/346,526, entitled FIREARM SIGHT HAVING LIFETIME ROUND COUNTER, filed May 27, 2022, which is incorporated by reference herein.

FIELD

This disclosure relates to a sight for a firearm, and, more particularly, to a system within a firearm sight that stores a lifetime record of the number of shots the firearm has fired.

BACKGROUND

Firearms may include dozens or hundreds of components. Due to their mechanical nature, some components of firearms are subject to wear as they are used; not necessarily based on the age of the firearm but rather based on the number of rounds fired by the firearm. Worn parts may cause the firearm to lose accuracy or become inoperative. Some parts, such as receivers, which may include various springs and levers, may wear more quickly than other parts, such as grips or trigger guards. Barrels and triggers or their components may also wear over time but may wear at different rates, i.e., depending on how many rounds are fired through the firearm. Knowing how many rounds have been fired through a firearm provides an information tool to the one responsible for proper firearm operation, who may be an owner, weapons master, or armorer. Using a round counter allows such a person to monitor the performance of the firearm against the anticipated wear based on the number of rounds the firearm has experienced.

Present round counters located in grips are inaccurate, as the shooter's hand buffers the recoil when fired. Additionally, when a firearm is firmly mounted to, for instance, a bench or the ground for sighting, rounds fired through the firearm may be missed and not counted, even though they contribute to the wear of the firearm. Other round counters may be mounted to the outside of a firearm, such as on the rail, which takes up valuable space which could be used to mount other accessories.

Embodiments of the disclosure address these and other limitations of the art.

DETAILED DESCRIPTION

Embodiments of the invention include a lifetime round counter embodied in a firearm sight. The sight may be mounted to a pistol slide or to a rifle, in its normal manner, without interfering with any operation of the firearm and without requiring specialized hardware over and above what is normally present with a firearm that includes a sight.

Optical sights, such as reflex or red-dot sights, provide a shooter a quick and easy way to sight a target compared to conventional iron sights. Reflex sights are optical sights that include a partially reflecting element on which an aiming light or target is projected. An LED or other light emitter is commonly used as the light source. When the emitter generates its light signal, the projected light reflects from the reflecting element, such as a lens or other optic, and the reflection is seen by the shooter as being superimposed on the target or field of view. This reflection is referred to as a Point of Aim (PoA). In operation, the shooter then aligns the target to the PoA to accurately aim the firearm at the target. Other sights generate a beam of light to be projected onto a target itself. Embodiments of the invention include a lifetime round counter embodied in a firearm sight, such as a reflex sight. Other embodiments may include a lifetime round counter embodied in a riflescope.

Figure 1:
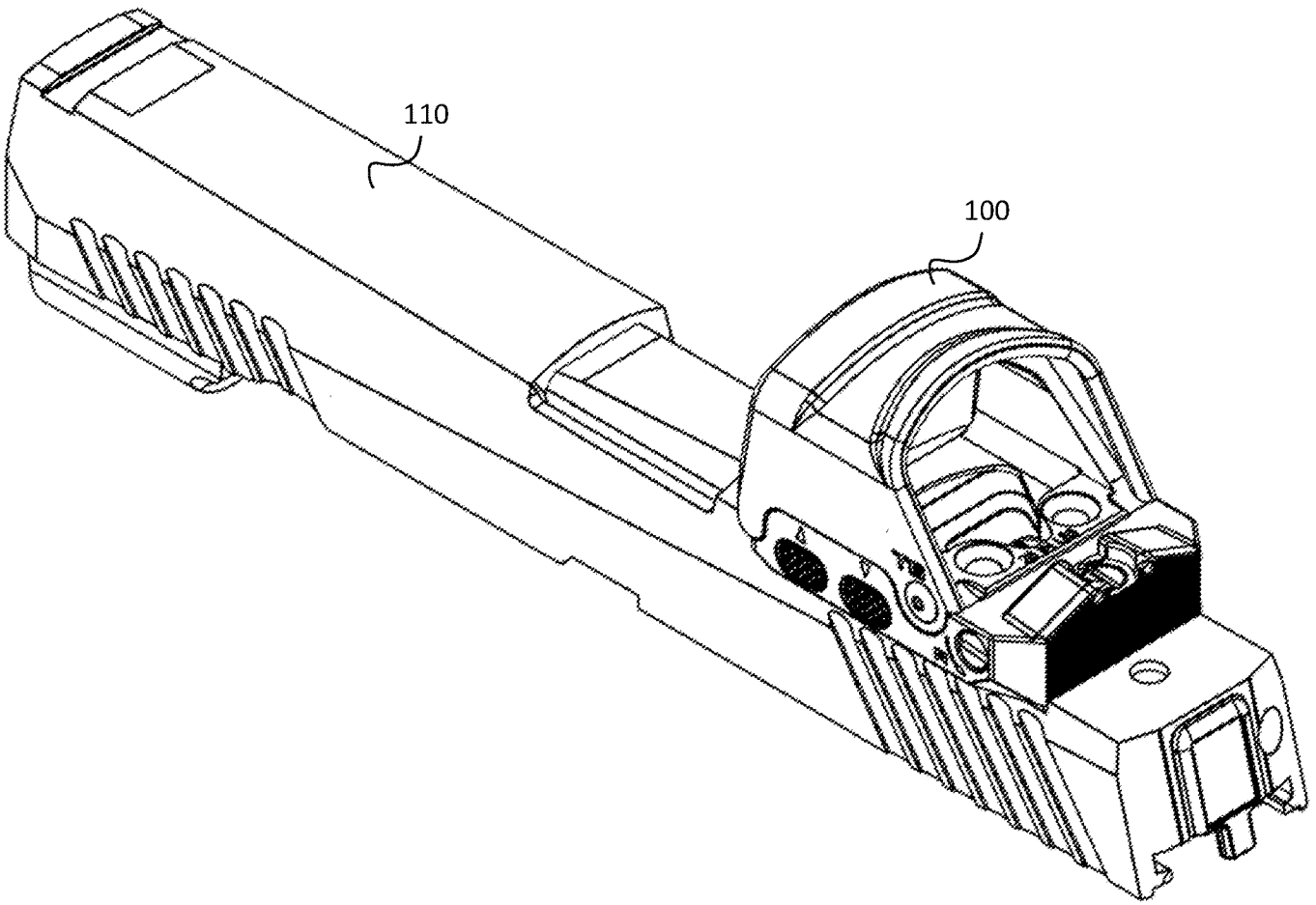
FIG. 1 is a perspective view of a firearm sight having a lifetime round counter according to embodiments of the disclosure, mounted to a pistol slide.
Figure 2:
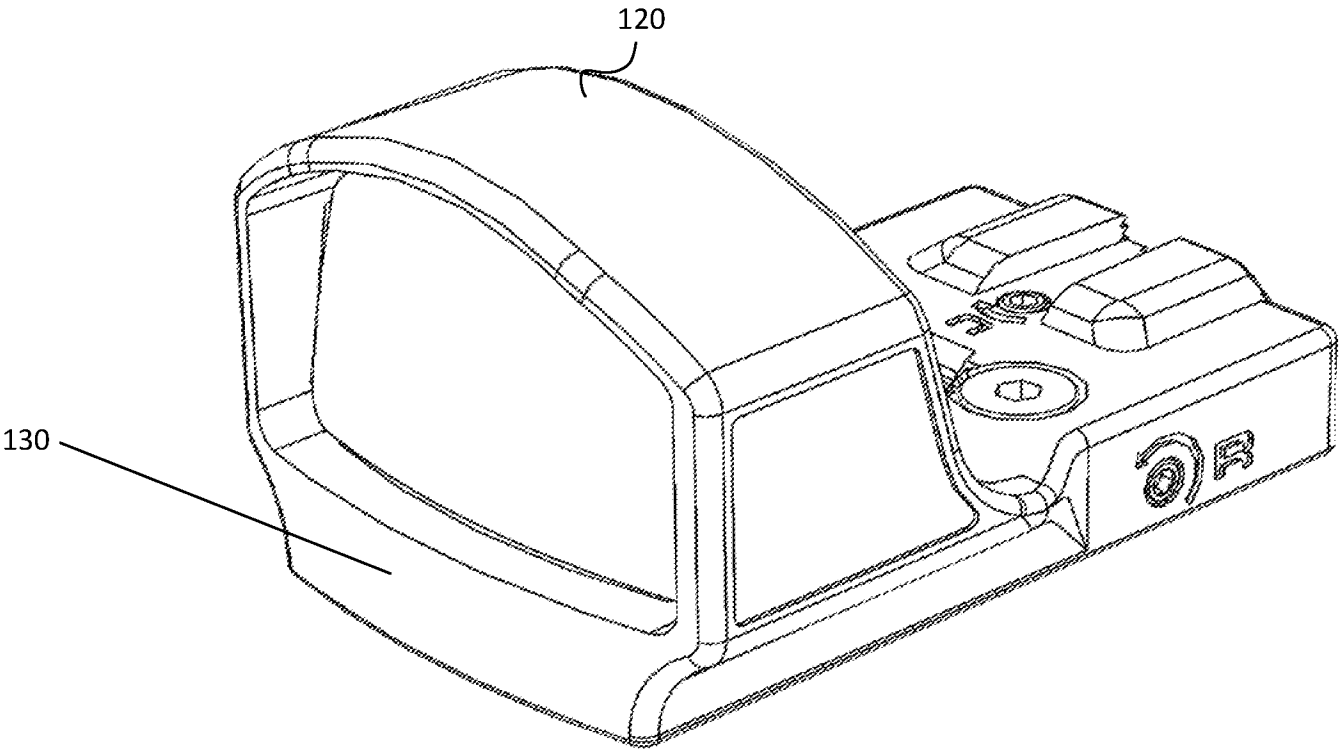
FIG. 2 is a perspective view of a firearm sight having a lifetime round counter according to embodiments of the disclosure.

FIG. 1 is a perspective view of a reflex sight 100 mounted on a pistol slide 110, while FIG. 2 illustrates an unmounted reflex sight 120. All of the components that provide the function of a lifetime round counter are housed within the sight, such as 100, 120, as illustrated by the reference 130 in FIG. 2. When a sight including a lifetime round counter is incorporated into a reflex sight mounted on a pistol slide, such as illustrated in FIG. 1, the reflex sight is exposed to maximum recoil impulse when the pistol is fired, as the pistol slide moves in conjunction with firing the pistol. This impulse may be converted to a signal or other action by using an accelerometer and evaluated, as described below. In some embodiments the accelerometer is a mechanical switch that closes an electrical circuit when a threshold amount of force, such as that generated by a firearm firing a round, is experienced by the firearm. Generating a maximum recoil impulse, as embodiments of the invention provide, allows embodiments of the invention to better distinguish instances of when a round is actually fired, compared to other events that may produce similar signatures, such as bumping or dropping the firearm. This implementation of having the sight mounted onto the pistol slide provides increased functionality and accuracy of the lifetime round count compared to round counters mounted elsewhere on a firearm.

Figure 3:
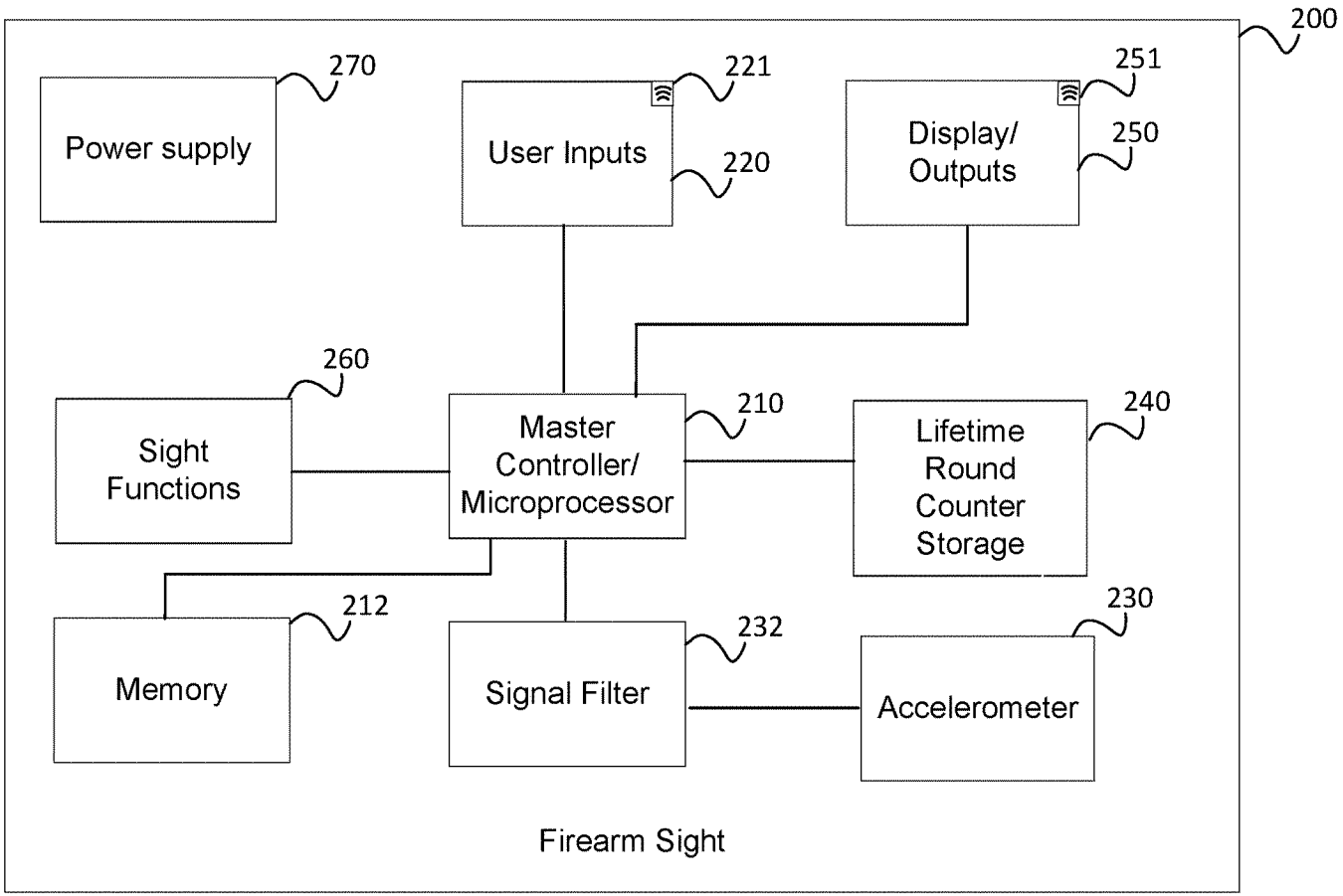
FIG. 3 is a functional block diagram illustrating example function and operations of a firearm sight, according to embodiments of the disclosure.

Elements of a sight including a lifetime round counter are functionally illustrated in FIG. 3. These elements may be fully integrated into a sight 100, 120, and are invisible to the user because they are completely housed within the body of the reflex sight. Electrical or other elements of the round counter may be mounted on a Printed Circuit Board (PCB) within the sight and fastened inside of the sight.

FIG. 3 is a functional block diagram illustrating example components and operations of a sight 200 including a lifetime round counter, according to embodiments. Not all of the components illustrated in FIG. 3 are necessary to implement a lifetime round counter, and other embodiments may include additional components or operations.

A master controller or microprocessor 210 performs the main operations of the sight 200. Although only one controller 210 is shown in FIG. 3 for ease of illustration, as will be understood by one skilled in the art, any number of processors or microcontrollers 210 of varying types may be used in combination, rather than a single controller or processor.

The controller 210 may be configured to execute instructions from a memory 212 and may perform any methods and/or associated steps indicated by such instructions. The memory 212 may be implemented as processor cache, random access memory (RAM), read only memory (ROM), solid state memory, non-volatile memory, or any other memory type. In some embodiments the memory 212 is integrated with the controller 210 and is not housed in a separate device. The memory 212 may also act as a medium for storing data, computer program products, and other instructions.

User inputs 220 are coupled to the controller 210 to control the operation of the sight 200. User inputs 220 may include one or more pushbuttons, a selectable menu, touch-screen, and/or any other controls employable by a user to interact with the sight 200. In some embodiments, the user inputs 220 may be made on another device, such as a mobile phone or computer and sent through a communication channel, wired or wireless, as indicated by reference 221, to the controller 210. A display or other form of output 250 is also coupled to and controlled by the controller 210. The display may include the PoA, or other information regarding the sight 200, such as the output of the lifetime round counter, as described below.

A power supply 270 provides power for the electrical components contained within the sight 200. Typically, the power supply 270 will be implemented by a replaceable battery, which is accessible through a battery drawer or other access for inserting and/or replacing the battery. In some embodiments the battery is rechargeable by either a charger that is permanently attached to an outer surface of the sight. In other embodiments the battery may be connectable to an attachable solar charger that is separate from the sight.

Sight functions 260 are illustrated in FIG. 3 to show that the sight 200 functions as a typical red-dot or reflex sight as described above. For example the typical sight functions 260 would include generating the PoA, as well as accepting user inputs to control brightness and providing an ability for sighting in the correct PoA position, among other functions.

Different from typical sights, the sight 200 includes an accelerometer 230. The accelerometer 230 converts the impulse of any motion the sight 200 experiences into a signal, such as an electrical signal. In other embodiments, the accelerometer 230 operates to create an electrical path between two nodes when a threshold-level force is experienced. The accelerometer 230 may be a solid state device, such as MEMS (Micro-Electro-Mechanical System) device, or a mechanical switch. In one embodiment, the accelerometer 230 is a single-axis mechanical switch, such as a mechanical switch available by SignalQuest of Lebanon New Hampshire. In a specific embodiment, the accelerometer 230 is a radially sensitive switch that is mounted perpendicular to the firing barrel. By being radially sensitive, the switch closes an electrical circuit between two nodes of the accelerometer 230 when a threshold amount of radial force is experienced by the accelerometer. Also, in single-axis mechanical accelerometers, the accelerometer 230 eliminates or minimizes noise that may be caused by movements of the firearm not caused by firing a round. The threshold amount of force the accelerometer 230 experiences may be matched to the expected force generated by the firearm when expending a round. In this way, incidental forces experienced by the firearm that do not reach this threshold amount and thus do not contribute to the overall wear of the firearm are not counted. But, as discussed in further detail below, other significant movements unrelated to shooting may still reach this threshold of force on the firearm, causing those movements to be counted as contributing to the wear of the firearm. In one embodiment, the threshold force is 1400 G, although accelerometers 230 having different thresholds, such as 1500-8000 G may be used. In one particular embodiment, the mechanical switch used as the accelerometer 230 is a SignalQuest SQ-ASE-1400-ITR. A pistol slide may experience between 6000-8000 G of shock when the pistol is fired.

The accelerometer 230 is coupled to a signal filter 232. In embodiments where the accelerometer 230 generates an electric signal, the signal filter 232 may include signal-filtering techniques such as bandpass filtering or signal smoothing. In embodiments where the accelerometer 230 is a mechanical switch, the signal filter 232 may include a de-bouncing function, so only a single event is captured even if the accelerometer generates two or more signals above the threshold within quick succession. For example, when the firearm is fired, it may cause a first impulse force, and when the slide impacts a slide stop, it may create a second impulse force. A de-bouncing interval, within which only a single event will be registered no matter how many individual signals are sensed above the threshold amount during the interval, may be pre-set to match the time period of movement of the pistol slide during a shooting event. In embodiments of the invention, the de-bounce interval is set to be between the slide travel period after a round is fired, generally 55 to 65 ms, and the period within which the shooter may shoot successive shots, such as 100 ms. Therefore, in embodiments, the de-bounce interval may be set anywhere between 65 ms and 100 ms. Particular embodiments may set the de-bounce interval in the signal filter 232 to be between 60-90 ms, and preferably at 80 ms or approximately 80 ms. In some embodiments, the de-bounce interval is set at the time of manufacture, although in other embodiments the de-bounce interval may be modified in firmware that controls the signal filter 232. While not the preferred embodiment, it is also possible that a user can set the de-bounce interval using the user inputs 220.

The controller 210 or other component within the sight 200 creates and stores a record of how many times the accelerometer 230 experiences threshold-exceeding events. This count records how many rounds have been fired by the firearm. It is possible that the accelerometer 230 may generate a 'false positive' when experiencing significant movements not related to shooting the firearm, such as if the firearm were to be dropped or significantly bounced. In some sense, such an event contributes to the wear of the firearm, so it may be preferable to record such events in the round counter along with the number of rounds actually fired. As mentioned above, the controller 210 or other component within the sight 200 counts the number of times the accelerometer 230 generates a threshold-exceeding event. In one embodiment, a counter is wired as a normally open switch to ground, with a passive pull-up resistor coupled to a power supply rail. The switched node is connected to an input of the controller 210. A recoil event sensed by the accelerometer 230 closes the switch and generates a logic LOW input to the controller 210, which detects the falling edge of the LOW input. In response, the controller 210 may generate a system interrupt and set an event flag. In some embodiments, the event flag may be limited to being set only once during a de-bounce period described above, which implements the de-bouncing function of the signal filter 232 described above. After the de-bounce interval, the event flag is cleared and a count-up flag is set. The count-up flag causes a counter function in the controller 210 to be incremented, after which the count-up flag is cleared. The fact that the counter has been incremented may be conveyed to the user, such as through the display 250. For example, the PoA marker may change appearance, such as blinking, or including another indicator, such as a visible circle surrounding the PoA when the counter is incremented. This informs the user that the counter is functional and that the shot has been registered.

The counter value is stored in a lifetime round counter storage 240, which stores the number of times the firearm to which the sight 200 is attached has been discharged, as well as other false-positive events that may have occurred to the firearm. The counter storage 240 may be embodied in NVRAM (Non-Volatile Random Access Memory), which may be integrated within the controller 210 or may be a stand-alone memory. In some embodiments, a new count is stored into the counter storage 240 every time the shot counter is incremented.

Accessing the data stored in the lifetime round counter 240 may be implemented in a number of different ways. For example, the user may use the user inputs 220 to cause information from the lifetime round counter 240 to be displayed on the display 250. In other embodiments the output 250 may include a wireless module 251 structured to send data contained in the lifetime round counter 240 through a wireless connection to a user device, such as sending the information to a mobile phone.

In one embodiment, the shot count stored in the lifetime round counter 240 may be generated and displayed by blinking the PoA marker on the reticle. In one example, as long as the pre-defined user input is received, such as depressing one or both input buttons of the user inputs 220, the reticle will blink repeat a sequence in order, beginning with the MSD (Most Significant Digit), then middle digits, then the LSD (Least Significant Digit. Each digit displays as a long blink for zero and a series of short blinks for the numbers 1 through 9, with one blink per number. For instance, in a three-digit shot counter, the count 204 from the lifetime round counter 240 would generate a PoA signal on the display 250 as 2 short blinks-pause-one long blink-pause-4 short blinks-long pause-(repeat). Other shot counters according to embodiments of the invention may include four-digits or even five-digits. Reading out the count does not affect the count. Also, the count could be reset manually by pressing a pre-selected pattern of button presses using the user inputs 220. For example, the count stored in the lifetime round counter 240 can be reset to zero by the controller 210 at any time by the user simultaneously holding down both of the buttons in the user inputs 220 for at least one second. The reset could be acknowledged by yet another signal shown on the reticle.

Yet other forms of retrieving the data stored in the lifetime round counter 240 may include coupling to a programming port, which may be accessible through a battery compartment. In such an implementation, the user would connect a cable between the programming port, which is coupled to the lifetime round counter 240 or to the controller 210, or both, and an external device. The user could then operate the external device to retrieve the data stored in the lifetime round counter 240.

Some embodiments of the invention may include more than one separate counter stored in the lifetime round counter storage 240, each of which could be independently reset. For example, an armorer may wish to know how many rounds were fired in a weekend. In this example, the armorer would reset one of the counters stored in the round counter storage 240 before the weekend shooting commences, and merely reads out the number of rounds stored in this second counter, using any of the above techniques, at the end of the exercise. Then the armorer could reset the second counter for another use. Note that resetting the second counter does not reset or affect the primary counter, which instead continues to count the number of lifetime rounds sensed by the sight 200. In some embodiments, the lifetime counter may not be able to be reset by the user to preserve the integrity of the lifetime round counter value stored in the lifetime round counter storage 240. In other embodiments, multiple separate counters (i.e., more than two) could be stored in the lifetime round counter storage 240, each accessible and/or resettable as described above.

The aspects of the present disclosure are susceptible to various modifications and alternative forms. Specific aspects have been shown by way of example in the drawings and are described in detail herein. However, one should note that the examples disclosed herein are presented for the purposes of clarity of discussion and are not intended to limit the scope of the general concepts disclosed to the specific aspects described herein unless expressly limited. As such, the present disclosure is intended to cover all modifications, equivalents, and alternatives of the described aspects in light of the attached drawings and claims.

References in the specification to aspect, example, etc., indicate that the described item may include a particular feature, structure, or characteristic. However, every disclosed aspect may or may not necessarily include that particular feature, structure, or characteristic. Moreover, such phrases are not necessarily referring to the same aspect unless specifically noted. Further, when a particular feature, structure, or characteristic is described in connection with a particular aspect, such feature, structure, or characteristic can be employed in connection with another disclosed aspect whether or not such feature is explicitly described in conjunction with such other disclosed aspect.

All features disclosed in the specification, including the description as well as the drawings, and all the steps in any method or process disclosed, may be combined in any combination, except combinations where at least some of such features and/or steps are mutually exclusive. Each feature disclosed in the specification, including the drawings, can be replaced by alternative features serving the same, equivalent, or similar purpose, unless expressly stated otherwise.

What is claimed is:

1. A target sight for mounting to a pistol slide of a pistol, the target sight comprising:

one or more accelerometers structured to convert an impulse force of pistol slide movement caused by firing a round of ammunition from the pistol to an impulse signal;

a timer having a time interval at least as long as a pistol slide movement time after the round of ammunition is fired; and a counter configured to increment a round count total of the target sight only a single time during the time interval when the impulse signal exceeds a threshold.

2. The target sight of claim 1, in which the target sight includes a user interface configured to convey the total number of rounds fired to a user.

3. The target sight of claim 1, in which the one or more accelerometers are configured to close an electrical circuit when the firearm experiences a threshold amount of force.

4. The target sight of claim 3, in which the one or more accelerometers comprise one or more solid state devices.

5. The target sight of claim 3, in which the one or more accelerometers comprise one or more single-axis mechanical switches.

6. The target sight of claim 1, in which at least one of the one or more counters is configured to be reset.

7. The target sight of claim 1 in which the time interval is greater than 55 ms.

8. The target sight of claim 7 in which the time interval is greater than 55 ms and less than 100 ms.

9. A target sight for mounting to a slide of a pistol, comprising:

a see-through optic for viewing a target; and one or more counters, including:

one or more accelerometers configured to close an electrical circuit when the pistol slide experiences a threshold amount of force, one or more signal filters coupled with the one or more accelerometers to create a filtered acceleration signal, and a memory for storing a number of times the filtered acceleration signal exceeded a threshold as a round counter.

10. The target sight according to claim 9, in which the one or more accelerometers comprise one or more solid state devices.

11. The target sight according to claim 9, in which the one or more accelerometers comprise one or more single-axis mechanical switches.

12. The target sight according to claim 11, further comprising a de-bouncer filter coupled to the one or more single-axis mechanical switches, the de-bouncer filter defining a time interval related to a time period of movement of the pistol slide when the pistol fires an ammunition round.

13. The target sight according to claim 9, in which the round counter is viewable on the optic.

14. The target sight according to claim 9, further comprising a user interface structured to accept input from a user, and in which the target sight is structured to show a display of the round counter based on inputs from the user interface.

15. The target sight according to claim 9, in which the one or more counters include one or more indicators configured to convey to a user that a round fired has been counted.

* * * * *